US006774546B2

(12) United States Patent
Gibboney, Jr.

(10) Patent No.: US 6,774,546 B2
(45) Date of Patent: Aug. 10, 2004

(54) MULTIPLE, PARALLEL FILAMENT LAMP

(76) Inventor: James W Gibboney, Jr., 3910 Dial Mill Rd., Conyers, GA (US) 30208

( * ) Notice: Subject to any disclaimer, the term of this patent is extended or adjusted under 35 U.S.C. 154(b) by 0 days.

(21) Appl. No.: 10/146,271

(22) Filed: May 15, 2002

(65) Prior Publication Data

US 2003/0214212 A1 Nov. 20, 2003

(51) Int. Cl.[7] ..... H01J 1/88; H01J 19/42; H01K 1/18

(52) U.S. Cl. ..... 313/272; 313/271; 313/273; 315/46; 315/47; 315/64

(58) Field of Search ..... 313/272, 273, 313/271, 276, 277, 275, 279; 315/46, 47, 49, 64, 67, 69, 74

(56) References Cited

U.S. PATENT DOCUMENTS

| | | | | | |
|---|---|---|---|---|---|
| 1,168,077 | A | * | 1/1916 | Jaeger | 313/273 |
| 1,601,470 | A | * | 9/1926 | Collins | 313/113 |
| 2,605,446 | A | | 6/1952 | Cartun | 315/65 |
| 2,862,147 | A | * | 11/1958 | Conti | 315/65 |
| 2,885,589 | A | * | 5/1959 | Curtis | 313/279 |
| 3,898,503 | A | * | 8/1975 | Shurgan | 313/491 |
| 4,179,637 | A | * | 12/1979 | Santora | 313/316 |
| 4,366,411 | A | * | 12/1982 | Robinson | 313/272 |
| 4,553,066 | A | | 11/1985 | Fields et al. | 313/580 |
| 4,556,822 | A | | 12/1985 | Lohrey et al. | 315/67 |
| 4,605,877 | A | | 8/1986 | Cho et al. | 313/272 |
| 4,841,196 | A | * | 6/1989 | Waymouth | 315/65 |
| 4,922,155 | A | | 5/1990 | Morris et al. | 315/205 |
| 4,935,662 | A | | 6/1990 | Kachenmeister, Jr. et al. | 313/279 |
| 5,061,879 | A | | 10/1991 | Munoz et al. | 315/65 |
| 5,079,474 | A | * | 1/1992 | Holten | 313/113 |
| 5,187,405 | A | | 2/1993 | Rachel et al. | 313/316 |
| 5,239,231 | A | | 8/1993 | Grunder | 313/579 |
| 5,384,510 | A | | 1/1995 | Arnold | 313/316 |
| 5,659,222 | A | | 8/1997 | Ragsdale et al. | 313/528 |
| 5,800,047 | A | | 9/1998 | Yang | 362/255 |
| 5,808,399 | A | | 9/1998 | Yoneyama | 313/271 |
| 5,932,973 | A | | 8/1999 | Cecchetti | 315/64 |
| 5,988,830 | A | | 11/1999 | Huang | 362/226 |

FOREIGN PATENT DOCUMENTS

| | | | | |
|---|---|---|---|---|
| EP | 280475 A2 | * | 8/1988 | H01K/9/02 |

* cited by examiner

*Primary Examiner*—Nimeshkumar D. Patel
*Assistant Examiner*—Kevin Quarterman
(74) *Attorney, Agent, or Firm*—Michael A. Mann; Nexsen Pruet Adams Kleemeier LLC

(57) ABSTRACT

An improvement to the usable lifetime of a lamp includes the use of a primary filament, a backup filament, and a means to switch portions of the backup filament into the current flow path after a portion of the primary filament open circuits. Using bypass shunts, which do not become electrically conductive until a portion of the primary filament open circuits, an open circuited portion of the primary filament can be electrically replaced with an associated backup filament portion to keep the lamp lit. The shunts in one embodiment are made of oxidized wire and are wrapped around the primary and backup filaments, in a spaced-apart relation, forming filament pairs consisting of a primary filament segment and its associated backup filament segment. In another embodiment, support brackets are used to not only support the primary and backup filaments, but are also used to provide the bypass shunt function as well.

19 Claims, 3 Drawing Sheets

MULTIPLE, PARALLEL FILAMENT LAMP

CROSS REFERENCE TO RELATED APPLICATIONS

Not Applicable

STATEMENT REGARDING FEDERALLY SPONSORED RESEARCH OR DEVELOPMENT

Not applicable.

REFERENCE TO A SEQUENCE LISTING, A TABLE, OR A COMPUTER PROGRAM LISTING COMPACT DISK APPENDIX

Not Applicable.

BACKGROUND OF THE INVENTION

The present invention relates to lamps. More particularly, the present invention relates to multi-filament lamps. Generally, inside the glass envelope or bulb of a lamp, a filament, which is usually made from tungsten, is extended between two power terminals. Basically, the filament is a resistor that heats up when a voltage is applied across the terminals, and normally operates at temperatures of about 2500° C. in incandescent lamps, and at significantly higher temperatures in halogen lamps. At these high temperatures the filament gives off a substantial amount of thermal radiation, which includes a considerable amount of visible light (when compared to the amount of visible light given off at lower operating temperatures). Also, these high temperatures cause some of the tungsten molecules to evaporate off of the filament and condense onto the glass bulb. This causes the filament to become thinner and more resistant to current flow, causing the thinner filament portion to become even hotter, and leading to further evaporation. Similarly, fabrication inefficiencies can also cause thin spots to be formed on the filament during manufacturing. Eventually, the loss of tungsten molecules will cause the filament to fail or "burn-out" and, due to the economics involved, an inoperable lamp is generally replaced and disposed of without expending any effort toward repair.

To extend the life of electric bulbs (or lamps), various methods have been employed to minimize, or compensate for, the loss of filament molecules. For example, incandescent bulbs are oftentimes filled with an inert gas—instead of operating the filaments in a partial vacuum inside of the bulb. Besides preventing filament combustion, the inert gas is a source of molecules that are used to collide with the evaporated tungsten molecules. Desirably, prior to the tungsten molecules condensing on the inside of the glass bulb, these collisions will redirect the tungsten molecules back toward the filament where they may be recovered. As another example, halogen lamps minimize the loss of tungsten filament molecules through the use of a process known as halogen recycling. Generally, halogen recycling is a chemical reaction that collects previously free tungsten molecules from the inside surface of the glass and then, due to the high temperature of the filament, re-deposits them on the filament.

A different approach to extending lamp life makes use of more than one filament. In this regard, multi-filament lamps have been described in a number of patents, for example, U.S. Pat. No. 4,553,066, issued to Fields et al. on Nov. 12, 1985, describes a multi-filament lamp that uses longitudinally extending filaments and a wire grid to help ensure that a failed filament does not break free and interfere with an operable filament. This invention, however, supplies power to each filament separately and, therefore, uses a separate lead-in wire for each filament, e.g., a three-filament lamp will require three lead-in wires and a common wire. Since the amount of time that a lamp is energized is the main cause of lamp failure, and since all of the filaments are simultaneously operating in this invention, lamp life may not be appreciably extended. In the U.S. Pat. No. 5,061,879, issued to Munoz et al. on Oct. 29, 1991, another multi-filament lamp is described. This invention, however, does not power each filament at the same time, but, on the other hand, this invention is only a two-filament lamp and it requires the use of an external control module for switching the second filament on after the first filament fails.

Furthermore, while light bulbs generally last for several hundred hours before burning out, some light bulbs will last much longer and are commonly referred to as "long life" bulbs. Generally, long life bulbs are made with a single, heavier gauge, filament and have a reduced resistance to current flow, but these bulbs are not as economical as standard bulbs and like standard bulbs must be replaced as soon as their single, heavier gauge filament fails. Thus, a need still remains for an economical way to extend the life of a light bulb.

SUMMARY OF THE INVENTION

According to its major aspects and briefly recited, the present invention is light bulb having at least two groups of filament segments and at least three filaments wherein, each group of filaments can be classified as primary filaments, which are a part of a series connected electrical circuit and, therefore, capable of initially being energized to provide illumination; backup (or secondary, or primary backup) filaments, which bypass a failed, i.e., open circuited, primary filament and become a part of the series circuit and, therefore, capable of being energized to provide illumination; and/or other subsequent level filaments (or subsequent level backups), which, in turn, bypass a failed, i.e., open circuited, prior level filament and become a part of the series circuit and, therefore, subsequently capable of being energized to provide illumination. Generally, filaments are fabricated by forming tungsten into a very fine wire having a diameter of about 50 microns, and then winding this wire into a double spiral coil and attaching the ends of the filament to power leads, which are attached to a support structure made of an insulator such as glass. Oftentimes, when a filament burns out, i.e., open circuits, it does so in one place along the length of the filament while the remainder of the filament is still usable, if this remaining operable portion could be connected back into an operable filament circuit. By using a two-filament group embodiment, containing a total of three filaments, as an example, but not as a limitation, two of the three filaments are primary filaments and are initially capable of providing illumination when the lamp is energized, and the other filament is a backup (or secondary) filament to one of the primary filaments. Since any of the embodiments of the present invention can be made to use filaments having the same, or different, electrical and/or luminosity characteristics, in this example it is assumed that one of the primary filaments is a lower gauge filament, is operating hotter, and/or is otherwise more likely to fail prior to the other primary filament. The secondary filament, in this example, through the use of shunts is connected in parallel with the more likely to fail filament. The shunts may include, but are not limited to, devices that are made of an oxidized metallic material, which does not become conductive until a breakdown voltage greater than the material's breakdown voltage rating is applied to it. In normal operation this magnitude of voltage, i.e., greater than the breakdown voltage rating, is not applied across the shunts, but upon failure of the primary filament to which the shunts are attached (which, in this example, is the more likely to fail filament) a voltage greater then the breakdown voltage rating is applied across the shunts and the backup filament becomes electrically connected in series with the operable primary filament, i.e., the backup filament bypasses the failed primary filament. Similarly, other embodiments of the present invention lamp may include, but are not limited to, those that have a separate backup filament across each of the primary filaments, which would allow for a separate backup filament to be used to bypass each failed primary filament, and/or at least one tertiary filament across at least one of the backup filaments, which will be used to bypass a failed, i.e., open circuited, backup filament and, therefore, become a part of the series filament circuit and, therefore, capable of being energized to provide illumination.

The primary filament segments are connected in series and can be positioned in an essentially straight configuration, in a semi-circular ring, or as an array, while the backup and/or subsequent level filament segments are also connected in series and are offset, or are spaced away, from their primary (or prior level) filament segment counterparts. The primary, the backup, and/or the other subsequent level, filament segments are preferably connected to support structures that are built within the interior of the lamp; however, the primary filament segments may be directly connected to these support structures while the backup (and/or the other subsequent level) filament segments are indirectly connected to these structures by being attached to the primary filament segments (and/or the other prior level filament segments) through stand-offs (or other similar support devices). Generally, each end of the series of primary filament segments is attached to a power lead (or other lead-in conductor), and each individual primary filament segment that has an associated backup filament segment, upon becoming open circuited, uses shunts to provide an electrical connection to their associated backup (or secondary) filament segment and the power leads—either directly or through other primary and/or backup filament segments. Similarly, when a backup (or secondary) filament segment becomes open circuited it also uses shunts to provide an electrical connection to its associated backup, which is a second-level backup (or a tertiary) filament segment.

Additionally, the backup (or secondary) filament segments may have a higher resistance than their associated primary filament segments to provide for proper shunt operation. Moreover, the backup (or secondary) filament segments are designed to provide the user with a visual indication that primary filament segments have failed before the entire system of filament segments becomes inoperative, i.e., the backup (or secondary) filament segments can be dimmer (or brighter) than the primary filament segments. Similarly, subsequent level filament segments will have a higher resistance than their prior level filament segments for the same purposes.

A feature of the present invention is the use of at least one backup (or secondary) filament segment. When the primary filament segment to which the backup (or secondary) filament segment burns out, the light will continue to operate by using the backup (or secondary) filament segment in place of the failed primary filament segment. Not only does the backup (or secondary) filament segment extend the usable life of the lamp, but, through the use of a number of groups, segments and/or backups, e.g., tertiary filament segments acting as second-level backups to backup (or secondary) filament segments, etc., the life of the lamp may be increased by a factor much greater than two while still maintaining high visible light emission efficiency. Generally, visible light emission efficiency is exchanged for long-life in most current "long-life" lamps. Related to this, the increased lifetime also reduces the time and cost of changing light bulbs by the same factor. Therefore, even allowing for a somewhat higher manufacturing cost for the present invention multiple, parallel filament lamp, the overall cost savings of the present lamp compared to prior art lamps may be significant.

Another feature of the present invention is the use of bypass shunts. Essentially the bypass shunts are located within the interior of the glass envelope surrounding the filaments and are used as switches to turn on the backup filaments when a filament burns out. Because the bypass shunts and the additional filaments are located within the interior of the present invention lamp, the present invention lamp can be used in standard light sockets without having to make modifications to the lamp or the lamp socket.

Still another feature of the present invention is the use of the open circuit voltage across a failed filament to activate a shunt in order to switch on a backup filament. This feature enables the backup filaments to operate sequentially and automatically on the failure of an associated filament.

Other features and their advantages will be apparent to those skilled in the art of lamp design from a careful reading of a Detailed Description Of Preferred Embodiment accompanied by the following drawings.

DETAILED DESCRIPTION OF THE INVENTION

The present invention is an improvement to electric lamps that is primarily directed, but not limited, to extending an incandescent lamp's lifetime. In particular, the improvement includes the use of backup filaments (or filament segments) that take the place of open circuited primary filament segments, and bypass shunts that automatically redirect the normal current flow path, i.e., the current path through the primary filament segments, to energize the backup filaments. This improvement should significantly extend the operating life of the lamp for each additional filament segment and/or group of backup filament segments that are used while still maintaining high visible light emission efficiency. Furthermore, because the changes to the lamp are incorporated within the interior of the lamp, the present invention improved lamp can be inserted into any existing lamp socket.

Figure 1:
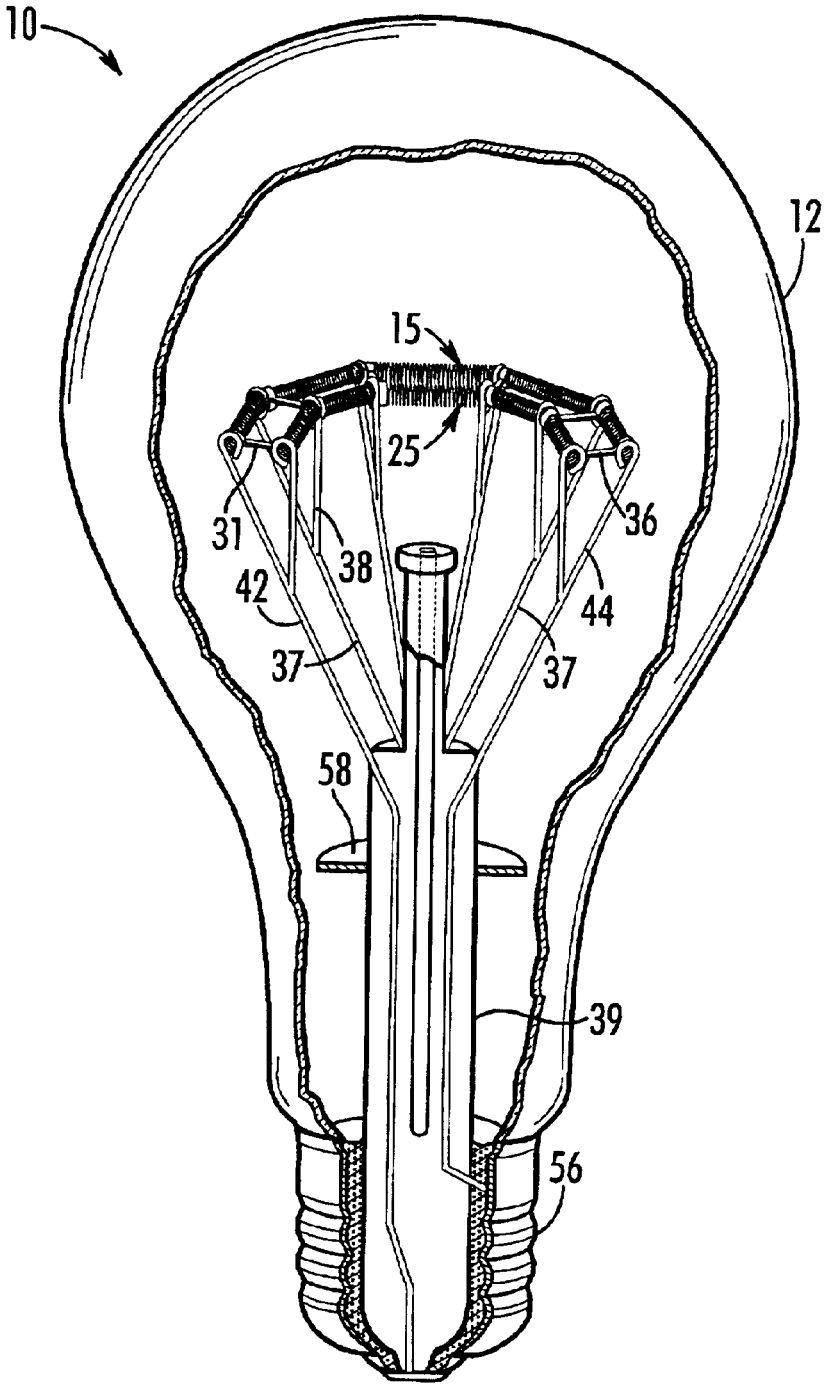
FIG. 1 is a perspective cut away view of the present invention lamp.
Figure 2A:
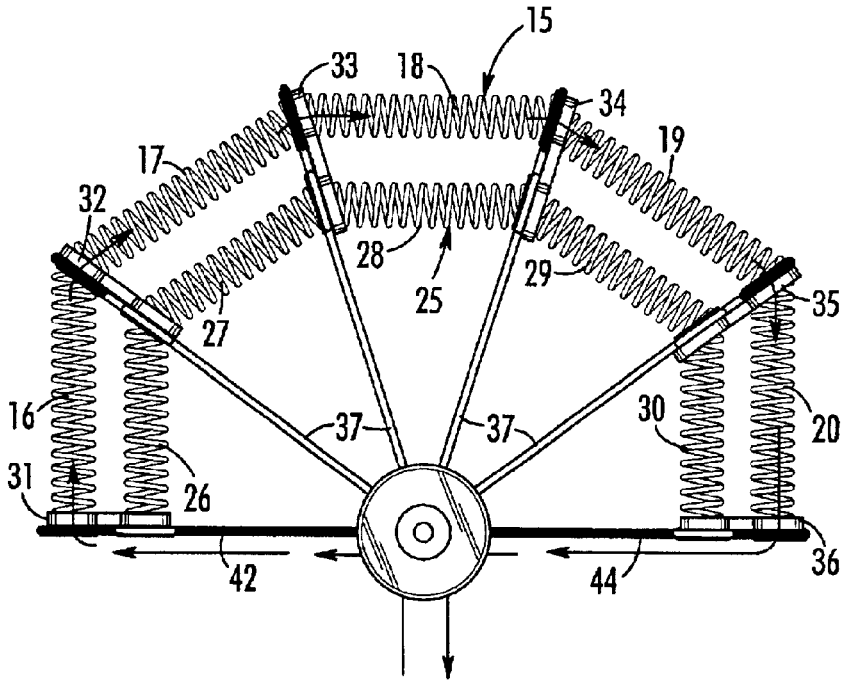
FIG. 2A is a plan view of a dual filament group embodiment of the present invention showing the current flow path during normal operation of all primary-group filaments, according to a preferred embodiment of the present invention.
Figure 2B:
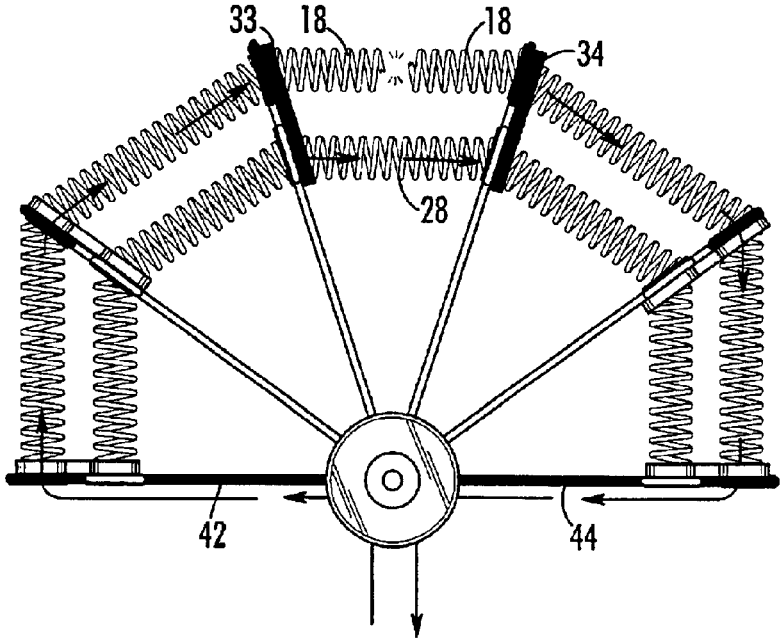
FIG. 2B is a plan view of the dual filament group embodiment shown in FIG. 2A showing an example of the current flow path during normal operation of a backup filament segment bypassing an open circuited primary filament segment.
Figure 3:
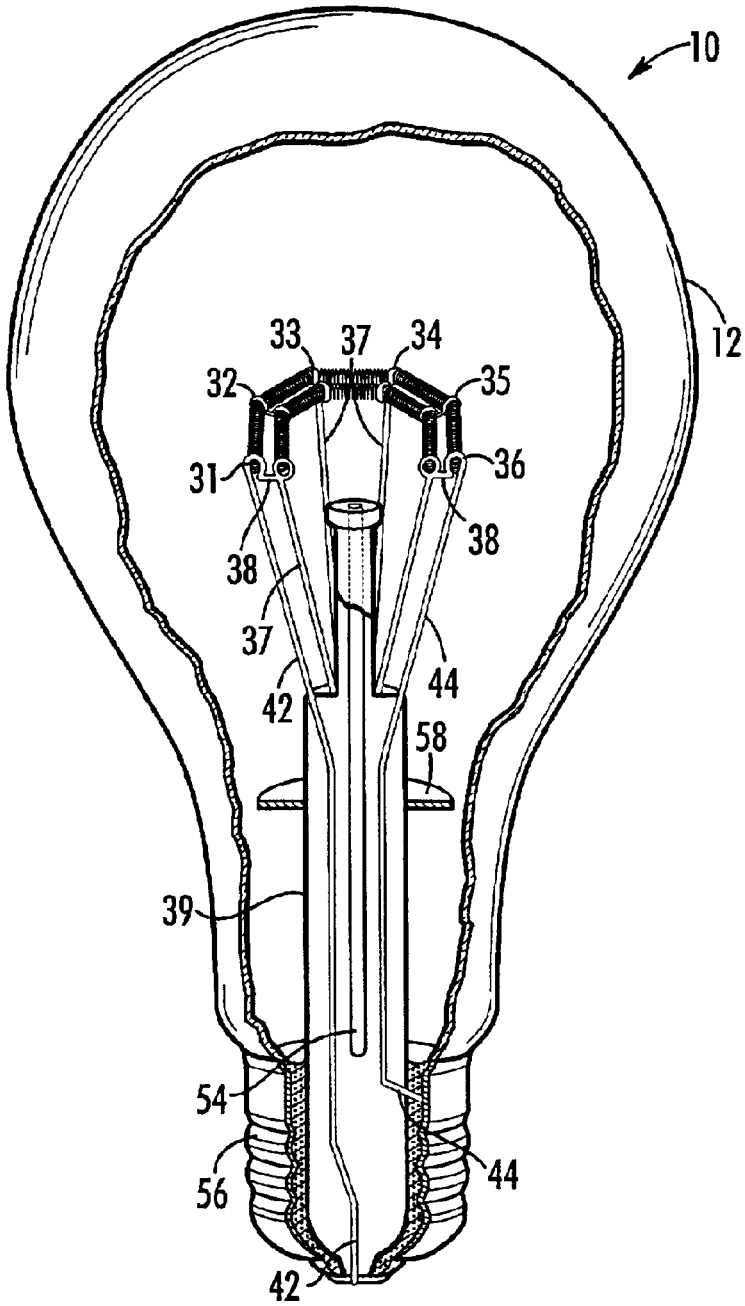
FIG. 3 is a perspective cut away view of another preferred embodiment of the present invention lamp.

FIGS. 1 and 3 illustrate embodiments of the present invention lamp, generally indicated by reference number 10, having a primary filament group 15 and one additional filament group that will be referred to herein as the backup filament group (or the secondary group, or the primary backup group) 25. The improved lamp 10 preferably includes a sealed, soft or hard glass, envelope 12; however, other suitable materials can be used as well. Carried within the interior of envelope 12 are the at least two filament groups 15 and 25 with at least two filaments in the primary group 15 and at least one filament in the backup group 25. Preferably, however, there are only two filament groups, the primary filament group 15 and the backup filament group 25, each having an equal number of filament segments, e.g., primary filament segments 16–20 and backup filament segments 26–30. Other embodiments, however, may contain a larger number (or a smaller number) of filament segments, and/or more filament groups. Preferably the filament segments 16–20 and 26–30 are made of tungsten, and are of the coiled-coil type, i.e., the tungsten is formed into a coil and then the coil is itself coiled; however, other suitable filament types and/or materials can be used as well. Additionally, the filament segments 16–20 and 26–30 may be discrete individual segments that may be electrically connected together with the other filament segments of their filament group by being welded, or soldered to terminals, to support posts, to each other, or by being electrically connected together by any other suitable electrical connection means or method. Preferably, however, the filament segments 16–20 and 26–30 are fabricated from two or more individual lengths of filament material, i.e., one length for each filament group, and then these lengths are virtually formed into multiple segments through the use of bypass shunts 31–36 (as shown in FIGS. 2A and 2B). While in another embodiment, the filament segments are fabricated from one continuous length of filament material and then formed into separate filament groups and/or filament segments. Preferably, the opposite ends of the primary filament group 15 are attached, by clamping, welding, and/or by any other suitable attachment means, to lead-in wires 42 and 44, which have been embedded into a glass support structure referred to herein as a glass mount 39. After the lead-in wires 42 and 44 have been attached to the filaments, the glass mount 39 is inserted into, and then fused to, the lamp envelope 12. The lead-in wires 42 and 44 are preferably made of copper and nickel; however, any other suitable materials can also be used. The lead-in wires 42 and 44 are used to carry the electrical current to and from the energized filaments in the primary and/or backup filament groups 15 and/or 25, and may be connected to at least one in-line fuse wire (not shown), which is used to protect the lamp 10, the associated electrical circuit(s), and/or any other electrically related components. The lead-in wires 42 and 44 may be supported by molybdenum, or any other suitable material, tie-wires (which are not shown), and the primary filament segments 16–20 are preferably supported by molybdenum, or any other suitable material, support-wires 37. Similarly, the backup filament segments 26–30 are generally supported by the support-wires 37 and/or by the primary filament group 15 through the use of support brackets 38. Preferably the support brackets 38 are non-conductive during normal lamp 10 operation; however, the support brackets 38 may also be used as shunts, switching in one or more backup filament segments 26–30 when necessary to bypass an open circuited primary filament segment 16–20, in which case, each support bracket 38 that is directly connected to an open circuited primary filament segment 16–20 will become conductive. When the support brackets 38 are also used to provide the shunt function, the support brackets 38 will also be referred to herein as bypass shunts 31–36 (the operation of which will be further discussed below). Preferably, in order to minimize the evaporation and/or the rapid oxidation of the filament material, the glass mount 39 will have an exhaust tube 54 that is used as an opening to the interior of the envelope 12, which allows the interior of the envelope to be pumped out of air and either filled with one or more inert gases, or just left with a vacuum. Afterwards, the exhaust tube 54 is either sealed, or the tube 54 is cut off and the opening sealed, and then the base 56, which is preferably made of aluminum or brass, is attached to the lamp envelope 12. Preferably, the inert fill gases are selected from a group containing argon, nitrogen, krypton, xenon, or mixtures of these gases; however, any other suitable fill gas can be used as well. Additionally, other embodiments of the present invention lamp 10 may pressurize the interior of the lamp envelope 12 to increase the number of inert gas molecules and to further minimize the evaporation of the filament material. The base 56 is used to bring electrical energy to the filament segments 16–20 and 26–30 by making an electrical connection with the lamp holder (not shown) and by having one lead-in wire 42 electrically connected to a center contact (not shown) on the bottom of the base 56 and the other lead-in wire 44 electrically connected to the base 56 itself. Another additional feature of the present invention lamp 10 is the possible use of a heat deflector 58 within the lamp envelope 12 to prevent the base 56 of the lamp 10 from overheating, especially in higher wattage embodiments.

Referring now to FIGS. 2A and 2B, as an example, but not as a limitation, the operation of the present invention lamp 10 will be described with reference to an embodiment having a primary filament group 15 and a backup filament group 25, each having five filament segments 16–20 and 26–30. With the lamp 10 already installed into a lamp holder and the lamp holder energized by a source of electrical current, the electrical current flow path is from the source of electrical current, through one of the lead-in wires 42 or 44, through the primary filament group 15 filament segments 16–20, and then through the other lead-in wire 42 or 44 and back to the source of electrical current. In the event that any of the primary filament group 15 filament segments 16–20 fail, a backup filament group 25 filament segment 26–29 or 30, i.e., the secondary (or primary backup) filament segment 26–29 or 30 associated with the failed filament segment 16–19 or 20, will be switched into the electrical current flow path through the use of bypass shunts 31–35 and/or 36; thereby, bypassing the failed primary filament segment 16–19 or 20 and allowing the lamp 10 to remain lit. In other words, the bypass shunts 31–36 are small oxidized metal (or other suitable material) connectors that function as one-shot switches that switch "on" a backup filament segment 26–29 or 30 by allowing current flow through that backup filament group 25 filament segment 26–29 or 30 when needed to bypass a failed primary filament group 15 filament segment 16–19 or 20. The bypass shunts 31–36 are preferably clamped or welded to the support-wires 37, the support brackets 38, and/or the lead-in wires 42 and 44; however, any other suitable attachment method can be used including, but not limited to, soldering, crimping, or any other application of bonding or mechanical force. In another embodiment, the bypass shunts 31–36 are oxidized wires that are preferably, wrapped and/or wound around: the support-wires 37; the support brackets 38; the primary and back-up filament groups 15 and 25; and/or the lead-in wires 42 and 44; or the bypass shunts 31–36 can be attached to the filament groups 15 and 25, the filament segments 16–20 and 26–30, or these other components 37, 38 and/or 42 and 44 by any other suitable method. In still other connection embodiments: the support brackets 38 themselves are the bypass shunts 31–36 and are used for carrying the filament segments 16–20 and 26–30; and/or the support-wires 37 and/or the support brackets 38 are designed to include lugs (not shown) for attaching the bypass shunts 31–36, the filament groups 15 and 25, and/or the filament segments 16–20 and 26–30 to the support-wires 37 and/or the support brackets 38. In any case, the bypass shunts 31–36 are, preferably, made of aluminum oxide or some other oxidized conductive material; however, any other suitable material including, but not limited to steel can be used as well. Normally the oxide coating on the bypass shunts 31–36 will not conduct electricity, so that electrical current flows as previously described—from the source of electrical current, through one of the lead-in wires 42 or 44, through the primary filament group 15 filament segments 16–20, and then through the other lead-in wire 42 or 44 and then back to the source of electrical current. However, after an individual primary filament group 15 filament segment 16–19 or 20 open circuits, (one or) two of the bypass shunts 31–35 or 36 will have full, or near full, line-voltage applied across their structures. This open circuit voltage breaks across the oxide coating of the (one or) two bypass shunts 31–35 or 36 (generally one shunt at a time) and causes the affected bypass shunts 31–35 or 36 to electrically connect the backup filament segment 26–29 or 30 (that is the primary backup segment 26–29 or 30 to the failed primary filament segment 16–19 or 20) across the failed segment 16–19 or 20. (In some instances, for example, where a backup filament segment is being switched on and it is adjacent to a previously switched on backup filament segment, only one bypass shunt will need to become conductive for the lamp to be illuminated.)

An example of the operation of the present invention lamp 10 can be described with reference to FIG. 2B. As shown in FIG. 2B, after the center primary filament segment 18 open circuits, full, or near full, line-voltage is applied to two of the bypass shunts 33 and 34, and, since this voltage is greater than the breakdown voltage rating of the bypass shunts 31–36, which is generally about 35 volts, these bypass shunts 33 and 34 become conductive and electrically connect the backup filament segment 28 (that is the backup to the failed primary filament segment 18) into the lamp circuit, i.e., the series connected filament circuit, causing it and the rest of the operable primary filament group 15 filament segments 16, 17, 19 and 20 to be capable of being energized and, therefore, illuminated. In normal continued operation, based on the same example, the remaining primary filament group 15 filaments segments, 16, 17, 19, and 20, the backup filament group 25 filament segments 26, 27, 29, and 30, and the bypass shunts 31, 32, 35, and 36 will operate in the same manner, i.e., the other primary filament group 15 filament segments 16, 17, 19, and 20 will eventually become open circuited (generally one at a time), the other bypass shunts 31, 32, 35, and 36 will become conductive (generally (one or) two at a time) and will electrically connect a backup filament segment 26, 27, 29, and/or 30 across the failed filament segment 16, 17, 19, and/or 20, allowing the lamp to remain lit for as long as there is a current flow path between the lead-in wires 42 and 44.

For proper operation of the lamp 10, the backup filament group 25 itself and/or the individual backup filament segments 26–30 will have a higher resistance than the primary filament group 15 and/or the individual primary filament segments 16–30 respectively. As an additional benefit of this difference in resistance, the lamp 10 will become dimmer as the primary filament group 15 filament segments 16–20 fail and are replaced by the backup filament group 25 filament segments 26–30, which provides the user with a visual indication, or warning, that the lamp 10 needs to be replaced before the lamp 10 completely burns out.

In another embodiment of the present invention lamp 10, additional crossing shunts (not shown) are attached between every two adjacent bypass shunts 31–36. These shunts are generally made of the same materials as the bypass shunts 31–36, and function and operate in the manner previously described for the bypass shunts 31–36. For normal crossing shunt operation, however, the crossing shunts will be manufactured so that their breakdown voltage and/or their "time from the application of the breakdown voltage until conduction" ratings are significantly higher then the same ratings for the bypass shunts 31–36. This will allow the bypass shunts 31–36 to become conductive well before the crossing shunts; thereby lowering the voltage applied across the crossing shunts before the crossing shunts become conductive. Each crossing shunt is used to provide a current flow path that bypasses both an individual failed primary filament segment 16–20 as well as its failed associated backup filament segment 26–30. This should prevent the entire lamp 10 from failing prematurely, and should allow the lamp 10 to have the opportunity to achieve its maximum usable lifetime. For example, the center segment 18 shown in FIG. 2B becomes open circuited and the backup filament segment 28 associated with the failed primary filament segment 18 (as its backup) also becomes open circuited, this causes the crossing shunt that is connected to the two bypass shunts 33 and 34 on each side of these two failed segments 18 and 28 to become conductive and provide a current flow path that bypasses these two failed segments 18 and 28, which will allow the lamp 10 to remain lit (if there is still a current flow path between the lead-in wires 42 and 44 through operable filaments segments).

As previously mentioned, there may be additional filament groups, e.g., a tertiary filament group that may act as a second-level backup group to the backup filament segments, and/or there may be additional or fewer filament segments in a group. Additionally, this may require the use of additional or fewer bypass shunts, support-wires, and/or any of the other previously mentioned components of the present invention lamp 10. Regardless of the different configurations, the method and manner of the construction and operation of the lamp 10 will be similar. Therefore, while the different features and functions of the present invention, as described herein, were described in the context of specific embodiments, these were for the purpose of describing the present invention and not as a limitation to the present invention. In this regard, any permutation of the different features and/or functions of the present invention, that is within the spirit and the scope of the description herein and/or within the spirit and scope of the claims appended hereto, can be considered to be combinations encompassed by the present invention. Moreover, those skilled in the art of lamp design and operation will see that many substitutions and modifications to the foregoing preferred embodiments are possible without departing from the spirit and scope of the preferred embodiments, as further defined by the following claims.

What is claimed is:

1. A lamp, comprising:

(a.) an envelope having an interior;

(b.) a base attached to said envelope having a bottom electrical contact, said bottom electrical contact and said base adapted to carry a flow of electric current between said bottom electrical contact and said base;

(c.) a primary electrode carried within said interior of said envelope, said primary electrode electrically connected to said bottom electrical contact and adapted to carry said flow of electric current;

(d.) a secondary electrode carried within said interior of said envelope, said secondary electrode electrically connected to said base and adapted to carry said flow of electric current;

(e.) at least one primary filament segment carried within said interior of said envelope in electrical communication with said primary electrode and said secondary electrode, said at least one primary filament segment adapted to carry said flow of electric current in an electrical circuit comprising said bottom electrical contact, said primary electrode, said at least one primary filament segment, said secondary electrode, and said base;

(f.) a plural number of bypass shunts operationally connected to said at least one primary filament segment;

(g.) at least one backup filament segment carried within said interior of said envelope operationally connected to said plural number of bypass shunts and to said at least one primary filament segment, wherein a separate primary filament segment from said at least one primary filament segment is paired with a separate backup filament segment from said at least one backup filament segment forming a filament pair, each said filament pair having two filament pair ends, wherein one of said plural number of bypass shunts is connected to each end of said two filament pair ends, wherein each of said plural number of bypass shunts is adapted to become electrically conductive and to electrically insert said at least one backup filament segment of each said filament pair into said electrical circuit when said at least one primary filament segment of each said filament pair becomes open circuited.

2. The lamp of claim 1, wherein said at least one primary filament segment is at least two primary filament segments.

3. The lamp of claim 1, wherein said at least one primary filament segment is at least three primary filament segments.

4. The lamp of claim 1, wherein said at least one primary filament segment is at least four primary filament segments.

5. The lamp of claim 1, wherein said at least one primary filament segment is at least five primary filament segments.

6. The lamp of claim 1, wherein each of said plural number of bypass shunts further comprises oxidized metallic wire attached to each said filament pair by being wrapped around said each filament pair end.

7. The lamp of claim 1, wherein each of said plural number of bypass shunts further comprises oxidized metallic material mechanically attached to each said filament pair at said each filament pair end.

8. The lamp of claim 1, wherein each of said plural number of bypass shunts further comprises oxidized metallic support brackets in operational connection with and supporting each said filament pair at said each filament pair end.

9. The lamp of claim 1, wherein each said separate primary filament segment from each said filament pair has a lower electrical resistance rating than said separate backup filament segment that said each said separate primary filament segment is paired with.

10. The lamp as recited in claim 2, wherein said at least one backup filament segment is at least two backup filament segments, and wherein at least two filament pairs are formed.

11. The lamp as recited in claim 3, wherein said at least one backup filament segment is at least three backup filament segments, and wherein at least three filament pairs are formed.

12. The lamp as recited in claim 4, wherein said at least one backup filament segment is at least four backup filament segments, and wherein at least four filament pairs are formed.

13. The lamp as recited in claim 5, wherein said at least one backup filament segment is at least five backup filament segments, and wherein at least five filament pairs are formed.

14. A lamp, comprising:

(a.) an envelope having an interior;

(b.) a base attached to said envelope bottom having a bottom electrical contact, said bottom electrical contact and said base adapted to carry a flow of electric current between said bottom electrical contact and said base;

(c.) a primary electrode carried within said interior of said envelope, said primary electrode electrically connected to said bottom electrical contact and adapted to carry said flow of electric current;

(d.) a secondary electrode carried within said interior of said envelope, said secondary electrode electrically connected to said base and adapted to carry said flow of electric current;

(e.) a primary filament carried within said interior of said envelope having a first end and an opposing second end, said primary filament in electrical communication with said primary electrode and said secondary electrode and adapted to carry said flow of electric current in an electrical circuit comprising said primary filament, said bottom electrical contact, said primary electrode, said secondary electrode and said base;

(f.) a first end bypass shunt attached to said first end of said primary filament;

(g.) a second end bypass shunt attached to said second end of said primary filament; and (h.) a backup filament carried within said interior of said envelope having a backup filament first end and an opposing backup filament second end, said backup filament first end attached to said first end bypass shunt and said backup filament second end attached to said second end bypass shunt causing said backup filament to be operationally connected to said primary filament, wherein said first end bypass shunt and said second end bypass shunt become electrically conductive when said primary filament becomes an open circuited primary filament causing said backup filament to become electrically inserted into said electrical circuit in place of said open circuited primary filament.

15. The lamp of claim 14, further comprising a plurality of interior bypass shunts operationally connected to said primary filament and to said backup filament in a spaced-apart relation along the length of said primary filament and said backup filament between said first end shunt and said second end shunt and forming a plurality of filament pairs between and inclusive of said first end bypass shunt and said second end bypass shunt, each of said plurality of filament pairs having a primary filament segment and a backup filament segment, wherein said plurality of interior bypass shunts in combination with said first end shunt and said second end shunt form a bypass shunt group, wherein each of said plurality of filament pairs is bounded by two bypass shunts from said bypass shunt group, and wherein the open circuiting of any said primary filament segment of a filament pair from said plurality of filament pairs will cause at least one of said two bypass shunts bounding said filament pair to become electrically conductive causing said backup filament segment of said filament pair to be electrically inserted into said electrical circuit in place of said primary filament segment of said filament pair that has become open circuited.

16. A lamp, comprising:

(a.) an envelope having an interior, said envelope having a top and an opposing bottom, said interior having a longitudinal axis extending from said bottom to said top of said envelope;

(b.) a base attached to said envelope having a bottom electrical contact, said bottom electrical contact and said base adapted to carry a flow of electric current between said bottom electrical contact and said base;

(c.) a primary electrode carried within said interior of said envelope, said primary electrode electrically connected to said bottom electrical contact and adapted to carry said flow of electric current;

(d.) a secondary electrode carried within said interior of said envelope, said secondary electrode electrically connected to said base and adapted to carry said flow of electric current;

(e.) a primary filament carried within said interior of said envelope having a first end and an opposing second end, said primary filament having a longitudinal length, said longitudinal length being measured from said first end to said second end, said primary filament in electrical communication with said primary electrode and said secondary electrode and adapted to carry said flow of electric current in an electrical circuit comprising said primary filament, said bottom electrical contact, said primary electrode, said secondary electrode and said base;

(f.) a backup filament carried within said interior of said envelope having a backup filament first end and an opposing backup filament second end, said backup filament having a longitudinal length that is positioned so that said backup filament is about parallel to said longitudinal length of said primary filament; and (g.) means for electrically bypassing an open circuited portion of primary filament, said electrically bypassing means operationally connected to said primary filament and to said backup filament in a spaced-apart relation along said longitudinal lengths of said primary filament and said backup filament, wherein said electrically bypassing means forms a plurality of filament pairs, each of said plurality of filament pairs having a primary filament portion and a backup filament portion, and wherein the open circuiting of any said primary filament portion of a filament pair from said plurality of filament pairs will cause said electrically bypassing means to become electrically conductive causing said backup filament portion of said filament pair to be electrically inserted into said electrical circuit in place of said primary filament portion of said filament pair that has become open circuited.

17. The lamp of claim 16, wherein said longitudinal length of said primary filament is arc shaped and said backup filament is positioned within the arc sector defined by said primary filament and by a first line from said first end of said primary filament to said longitudinal axis of said envelope and by a second line from said second end of said primary filament to said longitudinal axis of said envelope.

18. The lamp of claim 16, further comprising means for bypassing a failed filament pair, wherein both said primary filament portion and said backup filament portion of said filament pair have open circuited.

19. A lamp, comprising:

(a.) an envelope having an interior;

(b.) a base attached to said envelope having a bottom electrical contact, said bottom electrical contact and said base adapted to carry a flow of electric current between said bottom electrical contact and said base;

(c.) a primary electrode carried within said interior of said envelope, said primary electrode electrically connected to said bottom electrical contact and adapted to carry said flow of electric current;

(d.) a secondary electrode carried within said interior of said envelope, said secondary electrode electrically connected to said base and adapted to carry said flow of electric current;

(e.) a primary filament carried within said interior of said envelope having a first end and an opposing second end, said primary filament in electrical communication with said primary electrode and said secondary electrode and adapted to carry said flow of electric current in an electrical circuit comprising said primary filament, said bottom electrical contact, said primary electrode, said secondary electrode and said base;

(f.) a primary backup filament having a primary backup filament first end and an opposing primary backup filament second end operationally connected to said primary filament within said interior of said envelope;

(g.) a secondary backup filament having a secondary backup filament first end and an opposing secondary backup filament second end operationally connected to said primary backup filament within said interior of said envelope;

(h.) a plurality of first-level bypass shunts operationally connected to said primary filament and to said primary backup filament in a spaced-apart relation along the length of said primary filament and said primary backup filament and forming a plurality of first-level filament pairs along the length of said primary filament and said primary backup filament, each of said plurality of first-level filament pairs having a primary filament segment and a primary backup filament segment, wherein each of said plurality of first-level filament pairs is bounded by two first-level bypass shunts from said plurality of first-level bypass shunts, and wherein the open circuiting of any said primary filament segment of a first-level filament pair from said plurality of first-level filament pairs will cause at least one of said two first-level bypass shunts bounding said first-level filament pair to become electrically conductive causing said primary backup filament segment of said filament pair to be electrically inserted into said electrical circuit in place of said primary filament segment of said filament pair that has become open circuited; and (i.) a plurality of second-level bypass shunts operationally connected to said primary backup filament and to said secondary backup filament in a spaced-apart relation along the length of said primary backup filament and said secondary backup filament and forming a plurality of second-level filament pairs along the length of said primary backup filament and said secondary backup filament, each of said plurality of second-level filament pairs having a primary backup filament segment and a secondary backup filament segment, wherein each of said plurality of second-level filament pairs is bounded by two second-level bypass shunts from said plurality of second-level bypass shunts, and wherein the open circuiting of any said primary backup filament segment of a second-level filament pair from said plurality of second-level filament pairs will cause at least one of said two second-level bypass shunts bounding said second-level filament pair to become electrically conductive causing said secondary backup filament segment of said second-level filament pair to be electrically inserted into said electrical circuit in place of said primary backup filament segment of said second-level filament pair that has become open circuited.

* * * * *